US008895824B2

(12) United States Patent
Martin

(10) Patent No.: US 8,895,824 B2
(45) Date of Patent: Nov. 25, 2014

(54) REVERSE BRIDGE TENSION CONFIGURATION FOR A STRINGED INSTRUMENT

(71) Applicant: Billy Frank Martin, Fort Myers, FL (US)

(72) Inventor: Billy Frank Martin, Fort Myers, FL (US)

( * ) Notice: Subject to any disclaimer, the term of this patent is extended or adjusted under 35 U.S.C. 154(b) by 0 days.

(21) Appl. No.: 14/036,460

(22) Filed: Sep. 25, 2013

(65) Prior Publication Data

US 2014/0083275 A1 Mar. 27, 2014

Related U.S. Application Data

(60) Provisional application No. 61/705,785, filed on Sep. 26, 2012.

(51) Int. Cl.

| | |
|---|---|
| ***G10D 3/04*** | (2006.01) |
| ***G10D 3/12*** | (2006.01) |
| *G10D 1/08* | (2006.01) |

(52) U.S. Cl.

CPC .. *G10D 3/04* (2013.01); *G10D 1/08* (2013.01); *G10D 3/12* (2013.01)

USPC ..... 84/307

(58) Field of Classification Search

CPC ..... G10D 3/04; G10D 1/08; G10D 3/12

See application file for complete search history.

(56) References Cited

U.S. PATENT DOCUMENTS

| | | | | | |
|---|---|---|---|---|---|
| 539,789 | A * | 5/1895 | Boyd et al. | 84/298 |
| 601,071 | A * | 3/1898 | Borcur | 84/298 |
| 2,918,837 | A * | 12/1959 | Webster | 84/312 R |
| 3,443,467 | A * | 5/1969 | Richards | 84/307 |
| 4,320,685 | A * | 3/1982 | Pytlewski | 84/291 |
| 5,092,213 | A * | 3/1992 | Cipriani | 84/299 |
| 7,678,982 | B2 * | 3/2010 | Adams | 84/455 |
| 8,217,245 | B1 * | 7/2012 | McKenney | 84/267 |
| 8,569,602 | B2 * | 10/2013 | Nash et al. | 84/291 |
| 8,748,717 | B2 * | 6/2014 | Mason | 84/298 |
| 2014/0083275 | A1 * | 3/2014 | Martin | 84/307 |

* cited by examiner

*Primary Examiner* — Robert W Horn

(57) ABSTRACT

A reverse bridge tension configuration for a stringed instrument allows the stringed instrument to offset some of the tension felt by the bridge. For a typical stringed instrument such as a guitar, the tensioned strings are bound between the bridge and the headstock. However, the reverse bridge tension configuration loops the tensioned strings on a path that goes around the back of the instrument, through the body of the instrument, and back to the bridge. A reverse bridge is positioned on the corner of the soundboard and the back end so that the tensioned strings can loop around the back end without causing pressure damage to the outer surface of the instrument. Once the tensioned strings travel around the reverse bridge and into the body, channels are positioned within the body in order to guide the tensioned strings back to the bridge.

15 Claims, 8 Drawing Sheets

REVERSE BRIDGE TENSION CONFIGURATION FOR A STRINGED INSTRUMENT

The current application claims a priority to the U.S. Provisional Patent application Ser. No. 61/705,785 filed on Sep. 26, 2012.

FIELD OF THE INVENTION

The present invention relates generally to an apparatus that modifies the bridge on a guitar. More specifically, the present invention is an apparatus for a reverse bridge tension design.

BACKGROUND OF THE INVENTION

String musical instruments have been around for centuries. The composition of the string instrument includes a number of strings that are stretched over a soundboard that creates enormous amount of tension. When the strings vibrate, a sound is created from the vibration. Oftentimes, a string instrument such as a guitar will become deformed from the tension from the strings. Sometimes, the pulling force of the strings can even pull the bridge off of an acoustic guitar. It is therefore an object of the present invention to introduce an apparatus for a reverse bridge tension design that lessens the forward pull and tension created from the strings.

DETAILED DESCRIPTIONS OF THE INVENTION

All illustrations of the drawings are for the purpose of describing selected versions of the present invention and are not intended to limit the scope of the present invention.

Figure 1:
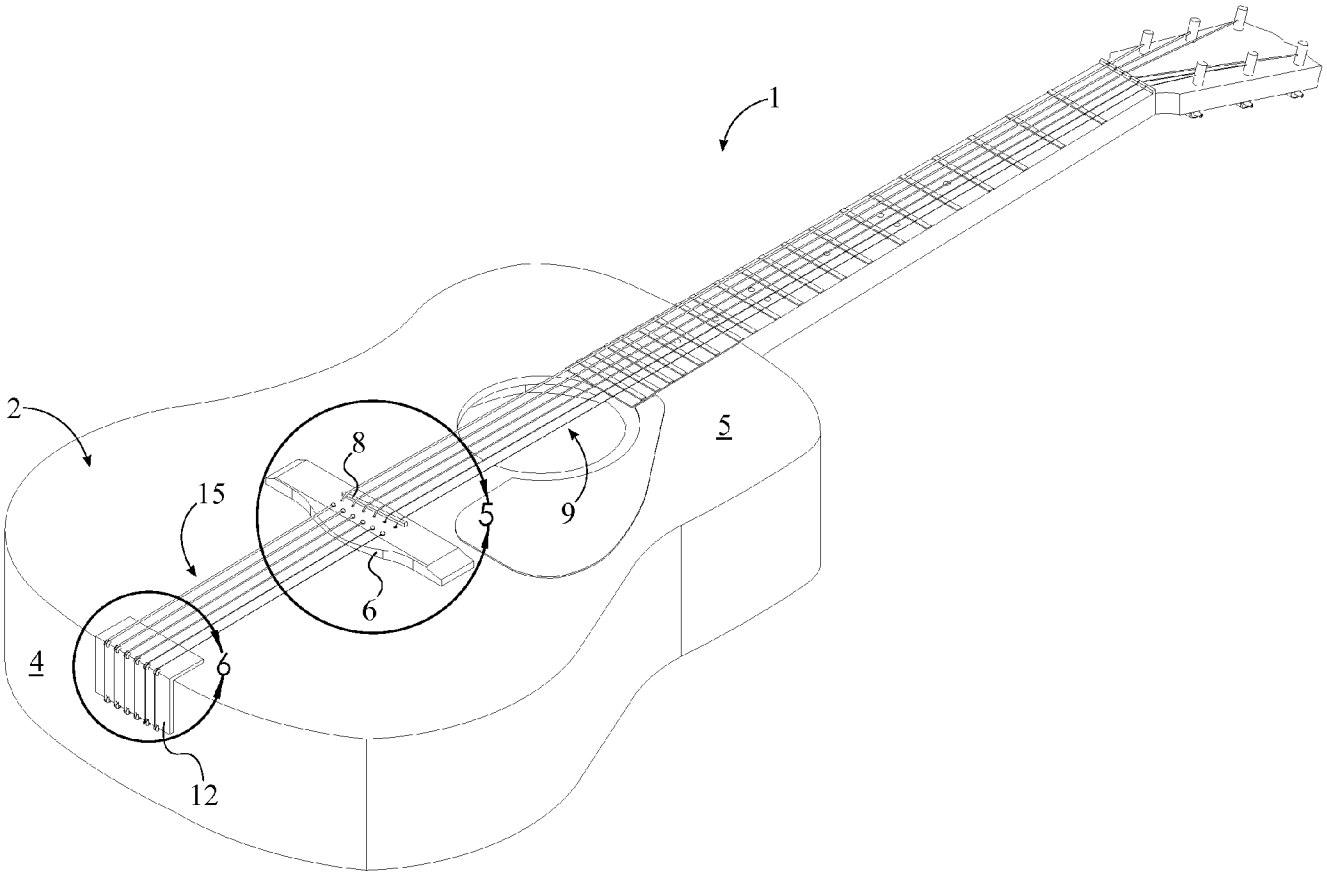
FIG. 1 is a perspective view of the present invention.

As can be seen in FIG. 1, the present invention is a reverse bridge tension configuration for a stringed instrument, which allows the stringed instrument offset a portion of the pulling force being felt between its body and its tensioned strings in order to produce a better tone. This pulling force is typically 150 to 170 pounds. More specifically, the present invention reduces the torque being felt by the bridge of the stringed instrument so that the stringed instrument is more stable around the bridge and is able to vibrate at a greater rate. The present invention mainly comprises a stringed instrument 1, a reverse bridge 12, and a plurality of looping assemblies 15. The stringed instrument 1 is any instrument that uses tensioned strings to generate sound. The present invention is designed to modify and improve a stringed instrument 1 such as an acoustic guitar. Each of the plurality of looping assemblies 15 is a collection of components that initially loops its respective string around the back of the stringed instrument 1 and then returns the respective string to its typical arrangement. The reverse bridge 12 is used to brace the tensioned strings against the back of the stringed instrument 1 without damaging the outer surface of the stringed instrument 1.

Figure 2:
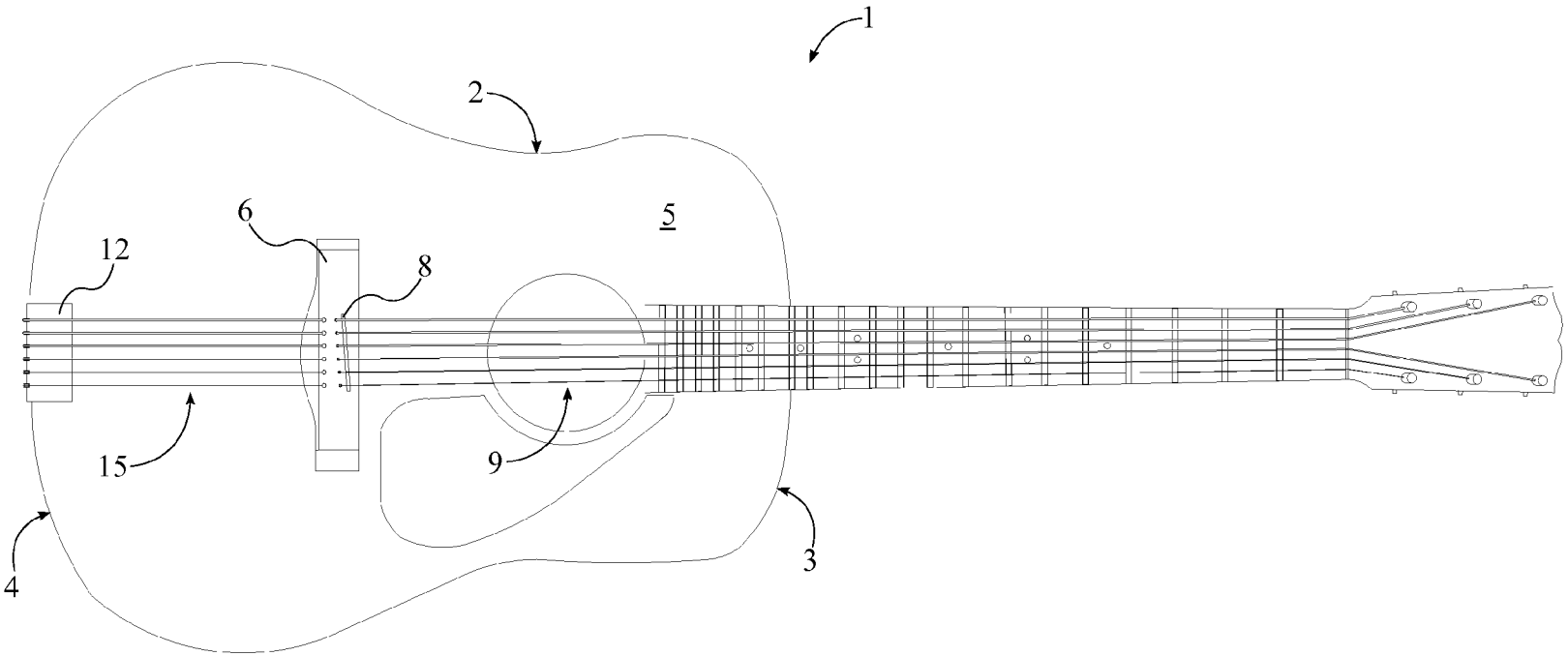
FIG. 2 is a top view of the present invention.
Figure 3:
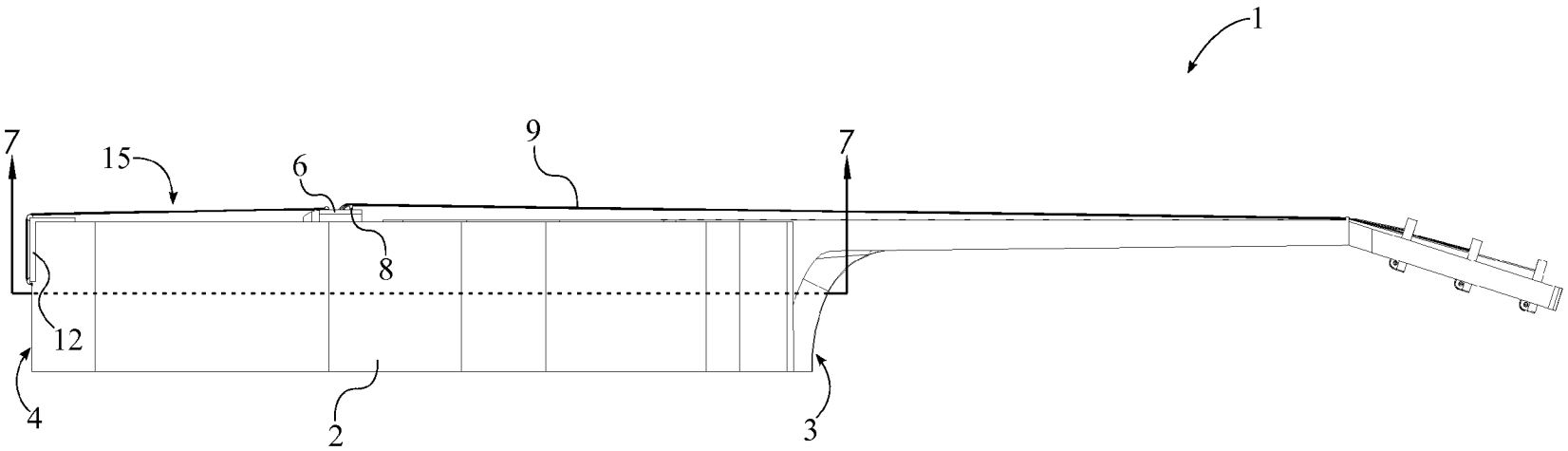
FIG. 3 is a side view of the present invention.
Figure 4:
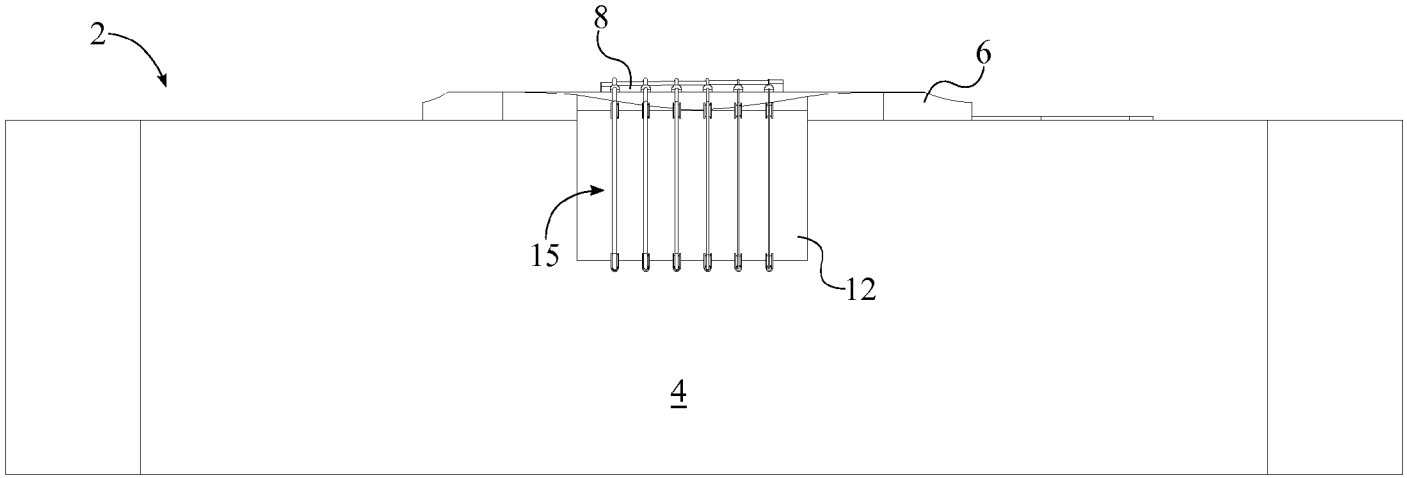
FIG. 4 is a back view of the present invention.

The present invention will modify specific parts of the stringed instrument 1 in order to relocate the path of the tensioned strings. The stringed instrument 1 comprises a body 2, a standard bridge 6, a bridge plate 7, a saddle 8, and a plurality of strings 9, which are shown in FIGS. 2, 3, and 4. The body 2 is used to resonant the vibrations that are produced by the plurality of strings 9. The standard bridge 6 is externally connected onto the body 2 so that the standard bridge 6 can be used as the medium to physically transfer the vibrations from the standard bridge 6 to the body 2. The bridge plate 7 structurally stabilizes the standard bridge 6 onto the body 2 and, thus, is internally connected onto the body 2 adjacent to the standard bridge 6. In addition, the body 2 comprises a front end 3, a back end 4, and a soundboard 5. The soundboard 5 is positioned in between the standard bridge 6 and the bridge plate 7, which allows the soundboard 5 to distribute the vibrations from the plurality of strings 9 throughout the rest of the body 2. The soundboard 5 is also positioned perpendicular to both the front end 3 and the back end 4. The plurality of strings 9 is typically tensioned over the front end 3, and the back end 4 is typically the butt of the stringed instrument 1. For example, if the stringed instrument 1 is a guitar, then the front end 3 of the body 2 would be adjacent to the neck of the guitar, and the back end 4 would be opposite the neck of the guitar. The saddle 8 is used to physically support the plurality of strings 9 on the standard bridge 6 so that the plurality of strings 9 has adequate space to properly vibrate and can transfer its vibrations to the proper location on the standard bridge 6. Thus, the plurality of strings 9 is the mechanical means of producing musical vibrations. For the present invention, the plurality of strings 9 is wrapped from the standard bridge 6, around the reverse bridge 12, through the body 2, and to the saddle 8. This path for each of the plurality of strings 9 is maintained by one of the plurality of looping assemblies 15.

The reverse bridge 12 is positioned at the back end 4 of the body 2 in order to loop the plurality of strings 9 around the back of the stringed instrument 1. The reverse bridge 12 comprises a first leg 13 and a second leg 14. The first leg 13 is perpendicularly connected to the second leg 14 so that the reverse bridge 12 can be mounted at the corner of the soundboard 5 and the back end 4. Moreover, the first leg 13 is externally mounted onto the soundboard 5, and the second leg 14 is externally mounted onto the back end 4. Thus, the reverse bridge 12 properly braces the body 2 while the plurality of strings 9 is tensioned along the path set by the plurality of looping assemblies 15. In different embodiments of the present invention, the reverse bridge 12 can be made of different kinds of materials such as wood or plastic. Also in the preferred embodiment of the present invention, the back leg 14 is one and a half inches long.

Figure 5:
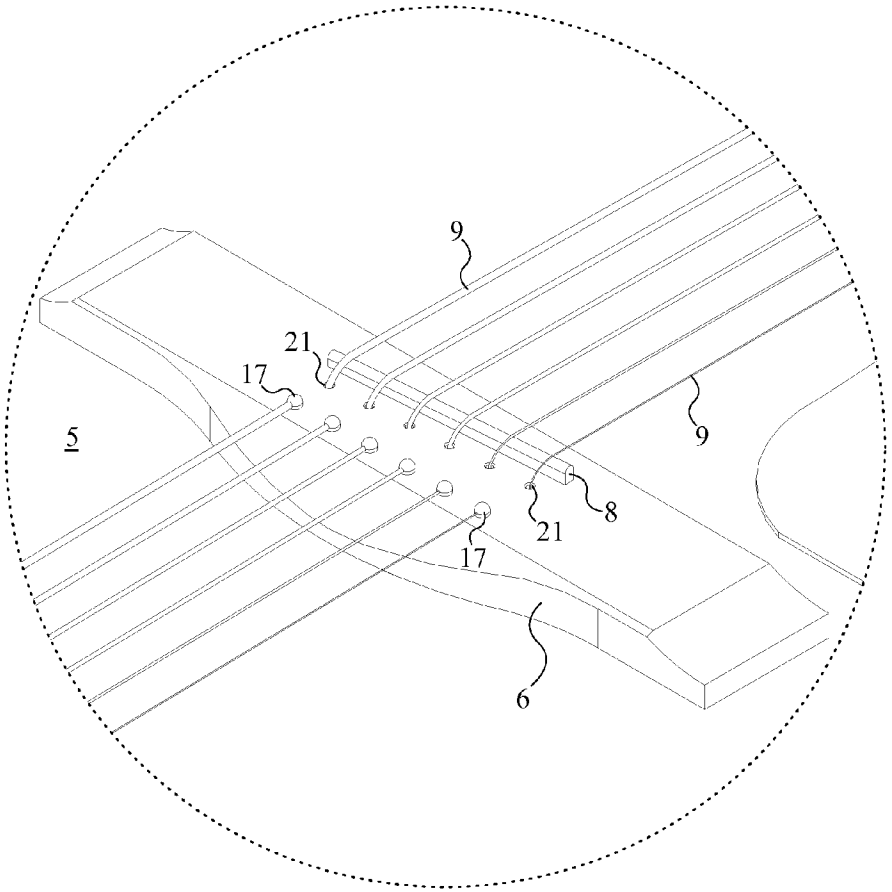
FIG. 5 is a detailed view of the standard bridge for the present invention and is referenced from FIG. 1.
Figure 8:
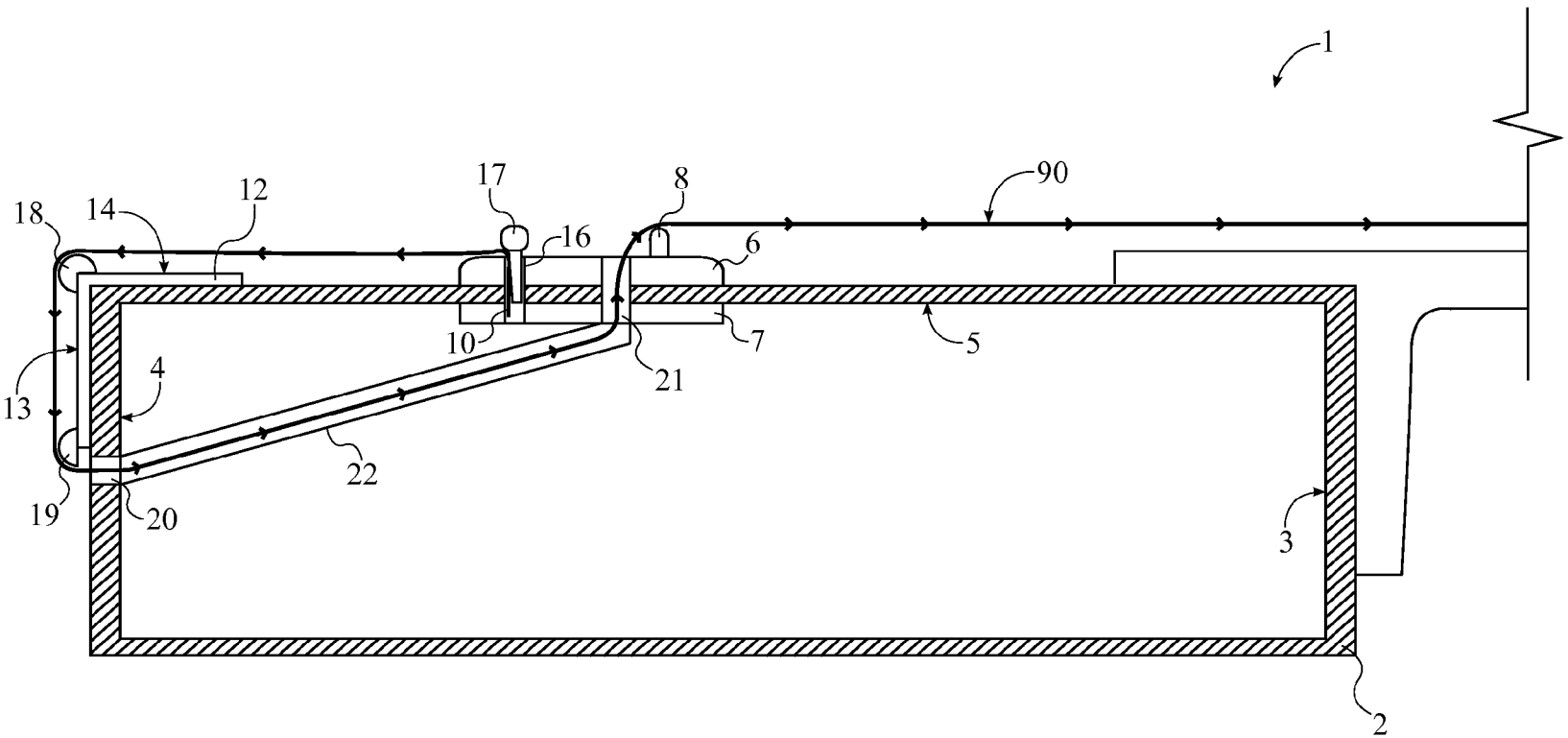
FIG. 8 is a schematic view of the present invention highlighting the path of a string through the present invention.

The plurality of looping assemblies 15 is evenly spaced across the standard bridge 6 so that the plurality of looping assemblies 15 can properly space the plurality of strings 9 apart from each other. For example, the spacing for the plurality of looping assemblies 15 will mimic the spacing for typical strings on a guitar. As can be seen in FIG. 8, each of the plurality of looping mechanisms 15 comprises a pinhole 16, a bridge pin 17, a first string guide 18, a second string guide 19, a first sleeve 20, a second sleeve 21, and a channel 22. The pinhole 16 and the bridge pin 17 are used to hold one end of a string at the proper starting point on the standard bridge 6, which is illustrated in FIG. 5. The end of the string is positioned within the pinhole 16, and the bridge pin 17 is inserted into the pinhole 16 in order to press the end of the string against the internal wall of the pinhole 16. The pinhole 16 and the saddle 8 are positioned opposite to each other across the standard bridge 6 so that the pinhole 16 is closer to the back end 4 of the body 2 and the saddle 8 is positioned closer to the front end 3 of the body 2. The pinhole 16 traverses through the standard body 2, through the soundboard 5, and the bridge plate 7, which provides the pinhole 16 with enough depth to properly secure the end of the string to the pinhole 16.

Figure 6:
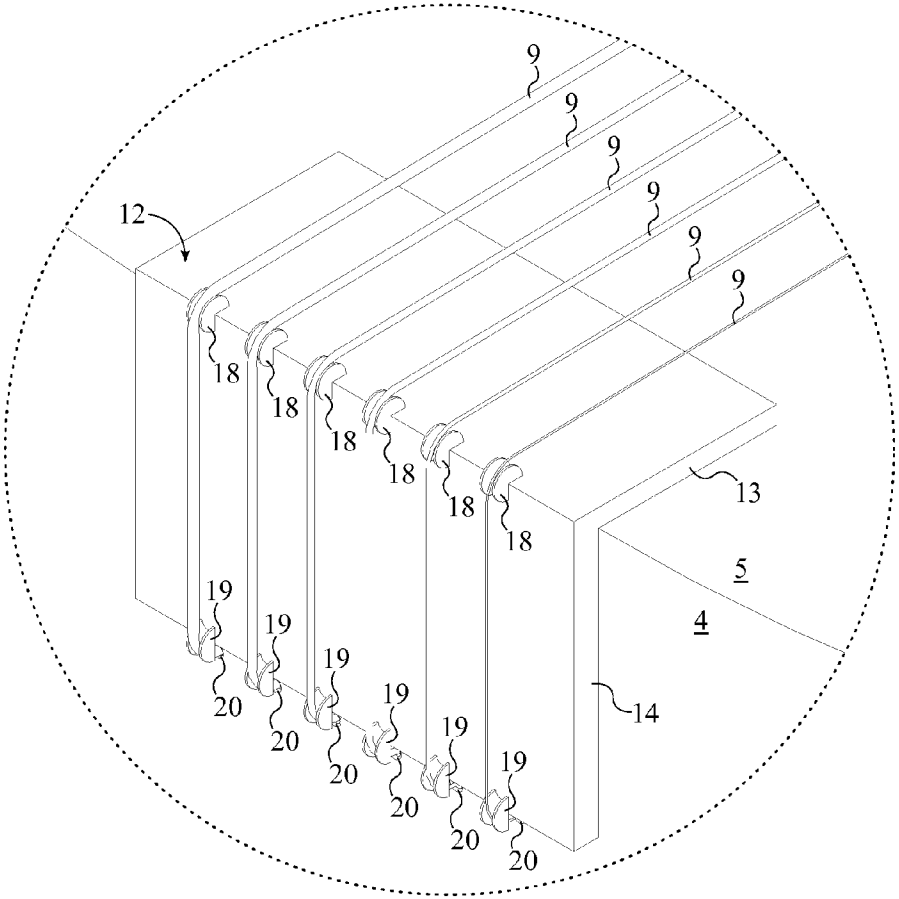
FIG. 6 is a detailed view of the reverse bridge for the present invention and is referenced from FIG. 1.

As can be seen in FIG. 6, the parts of a looping assembly that are located on the reverse bridge 12 are the first string guide 18 and the second string guide 19. The first string guide 18 and the second string guide 19 are used to direct the path of a string around the reverse bridge 12. The first string guide 18 and the second string guide 19 can be, but is not limited to, rollers or grooves that are shaped to smoothly change the path of a string around the reverse bridge 12. The first string guide 18 and the second string guide 19 are positioned opposite to each other along the second leg 14 of the reverse bridge 12, which allows the first string guide 18 to receive a string coming from the standard bridge 6 and allows the second string guide 19 to send the string into the body 2 of the stringed instrument 1.

Figure 7:
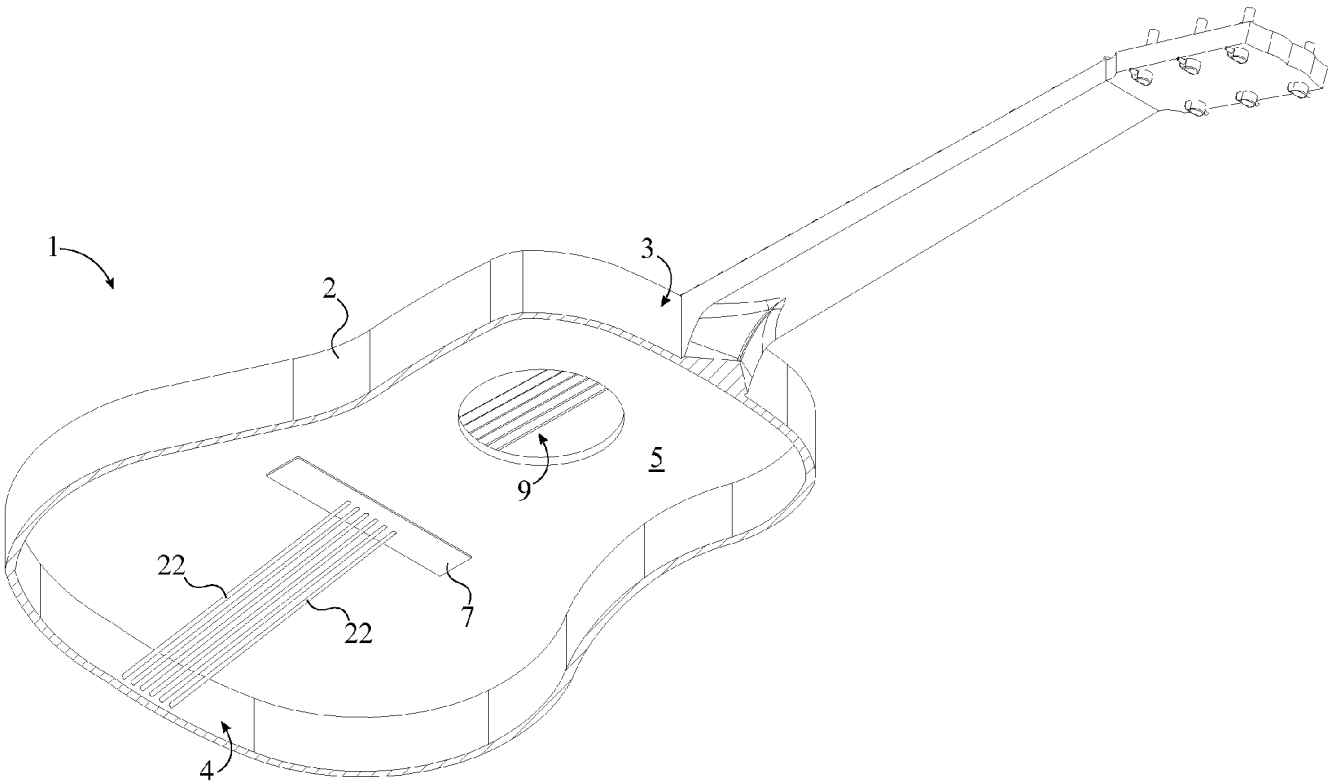
FIG. 7 is a cross sectional view from the bottom of the present invention and is referenced in FIG. 3.

The first sleeve 20, the second sleeve 21, and the channel 22 are used to direct the path of a string through the body 2 of the stringed instrument 1. The first sleeve 20 is a hollow insert that guides a string through a wall of the body 2. More specifically, the first sleeve 20 traverses through the back end 4 adjacent to the reverse bridge 12 so that the first sleeve 20 can immediately guide the path of a string into the body 2 after travelling around the reverse bridge 12. Similarly, the second sleeve 21 is a hollow insert the guides the string through a wall of the body 2. More specifically, the second sleeve 21 traverses through the bridge plate 7, the soundboard 5, and the standard bridge 6 so that the second sleeve 21 can guide the path of a string back to standard bridge 6. The second sleeve 21 is also positioned in between the pinhole 16 and the saddle 8 so that the string can be immediately braced by the saddle 8. As can be seen in FIG. 7, the channel 22 traverses through the body 2 from the first sleeve 20 to the second sleeve 21, which allows a string to follow a straight path from the first sleeve 20 to the second sleeve 21.

In summary, each of the plurality of looping assemblies 15 modifies the path of its respective string 90 from the plurality of strings 9. The components of a looping assembly are collectively used to modify the path of its respective string 90, which is illustrated in FIG. 8. The path begins by mounting the first end 10 of the respective string 90 within the pinhole 16 by using the bridge pin 17. The path continues by directing the respective string 90 towards the first string guide 18 by also using the bridge pin 17. The path proceeds by redirecting the respective string 90 towards the second sleeve 21 by using the first string guide 18. After the respective string 90 is braced by the second string guide 19, the respective string 90 will traverse through the first sleeve 20, the channel 22, and the second sleeve 21, which loops the path back to the standard saddle 8. The path proceeds by directing the respective string 90 towards the saddle 8 by using the second sleeve 21. The path is then redirected towards the front end 3 by using the saddle 8. In some embodiments of the present invention, the respective string 90 may not be long enough to traverse the entire path of its looping assembly and may require an extension that can be attached to the end of the respective string 90. In one embodiment, the extension for the respective string 90 is 18 inches long.

Although the invention has been explained in relation to its preferred embodiment, it is to be understood that many other possible modifications and variations can be made without departing from the spirit and scope of the invention as hereinafter claimed.

What is claimed is:

1. A reverse bridge tension configuration for a stringed instrument comprises:
- a stringed instrument;
- a reverse bridge;
- a plurality of looping assemblies;
- said stringed instrument comprises a body, a standard bridge, a bridge plate, a saddle, and a plurality of strings;
- said reverse bridge comprises a first leg and a second leg;
- each of said plurality of looping assemblies comprises a pinhole, a bridge pin, a first string guide, a second string guide, a first sleeve, a second sleeve, and a channel;
- said body comprises a front end, a back end, and a soundboard;
- said plurality of looping mechanisms being evenly spaced across said standard bridge;
- said reverse bridge being positioned at said back end; and
- said plurality of strings being wrapped from the said standard bridge, around said reverse bridge, through said body, and to said saddle by said plurality of looping assemblies.

2. The reverse bridge tension configuration for a stringed instrument as claimed in claim 1 comprises:
- said standard bridge externally connected onto said body;
- said bridge plate being internally connected onto said body adjacent to said standard bridge;
- said soundboard being positioned perpendicular to both said front end and said back end; and
- said soundboard being positioned in between said standard bridge and said bridge plate.

3. The reverse bridge tension configuration for a stringed instrument as claimed in claim 1 comprises:
- said pinhole and said saddle being positioned opposite to each other across said standard bridge; and
- said pinhole traversing through said standard bridge, said soundboard, and said bridge plate.

4. The reverse bridge tension configuration for a stringed instrument as claimed in claim 1 comprises:
- said first leg being perpendicularly connected to said second leg;
- said first leg being externally mounted onto said soundboard; and
- said second leg being externally mounted onto said back end.

5. The reverse bridge tension configuration for a stringed instrument as claimed in claim 1 comprises:
- said first string guide and said second string guide being connected onto said reverse bridge; and
- said first string guide and said second string guide being positioned opposite to each other along said second leg.

6. The reverse bridge tension configuration for a stringed instrument as claimed in claim 1 comprises:
- said first sleeve traversing through said back end adjacent to said reverse bridge;
- said second sleeve traversing through said bridge plate, said soundboard, and said standard bridge;
- said second sleeve being positioned in between said pinhole and said saddle; and
- said channel being traversing through said body from said first sleeve to said second sleeve.

7. The reverse bridge tension configuration for a stringed instrument as claimed in claim 1 comprises:
- a respective string from said plurality of strings;

a first end of said respective string being mounted within said pinhole by said bridge pin;

said respective string being directed towards said first string guide by said bridge pin;

said respective string being redirected towards said second string guide by said first string guide;

said respective string being redirected into said first sleeve by said second string guide;

said respective string traversing through said first sleeve, said channel, and said second sleeve;

said respective string being directed towards said saddle by said second sleeve; and said respective string being redirected towards said front end by said saddle.

8. A reverse bridge tension configuration for a stringed instrument comprises:

a stringed instrument;

a reverse bridge;

a plurality of looping assemblies;

said stringed instrument comprises a body, a standard bridge, a bridge plate, a saddle, and a plurality of strings;

said reverse bridge comprises a first leg and a second leg;

each of said plurality of looping assemblies comprises a pinhole, a bridge pin, a first string guide, a second string guide, a first sleeve, a second sleeve, and a channel;

said body comprises a front end, a back end, and a soundboard;

said plurality of looping mechanisms being evenly spaced across said standard bridge;

said reverse bridge being positioned at said back end;

said plurality of strings being wrapped from the said standard bridge, around said reverse bridge, through said body, and to said saddle by said plurality of looping assemblies;

said first sleeve traversing through said back end adjacent to said reverse bridge;

said second sleeve traversing through said bridge plate, said soundboard, and said standard bridge;

said second sleeve being positioned in between said pinhole and said saddle; and said channel being traversing through said body from said first sleeve to said second sleeve.

9. The reverse bridge tension configuration for a stringed instrument as claimed in claim 8 comprises:

said standard bridge externally connected onto said body;

said bridge plate being internally connected onto said body adjacent to said standard bridge;

said soundboard being positioned perpendicular to both said front end and said back end;

said soundboard being positioned in between said standard bridge and said bridge plate;

said pinhole and said saddle being positioned opposite to each other across said standard bridge; and said pinhole traversing through said standard bridge, said soundboard, and said bridge plate.

10. The reverse bridge tension configuration for a stringed instrument as claimed in claim 8 comprises:

said first leg being perpendicularly connected to said second leg;

said first leg being externally mounted onto said soundboard;

said second leg being externally mounted onto said back end;

said first string guide and said second string guide being connected onto said reverse bridge; and said first string guide and said second string guide being positioned opposite to each other along said second leg.

11. The reverse bridge tension configuration for a stringed instrument as claimed in claim 8 comprises:

a respective string from said plurality of strings;

a first end of said respective string being mounted within said pinhole by said bridge pin;

said respective string being directed towards said first string guide by said bridge pin;

said respective string being redirected towards said second string guide by said first string guide;

said respective string being redirected into said first sleeve by said second string guide;

said respective string traversing through said first sleeve, said channel, and said second sleeve;

said respective string being directed towards said saddle by said second sleeve; and said respective string being redirected towards said front end by said saddle.

12. A reverse bridge tension configuration for a stringed instrument comprises:

a stringed instrument;

a reverse bridge;

a plurality of looping assemblies;

said stringed instrument comprises a body, a standard bridge, a bridge plate, a saddle, and a plurality of strings;

said reverse bridge comprises a first leg and a second leg;

each of said plurality of looping assemblies comprises a pinhole, a bridge pin, a first string guide, a second string guide, a first sleeve, a second sleeve, and a channel;

said body comprises a front end, a back end, and a soundboard;

said plurality of looping mechanisms being evenly spaced across said standard bridge;

said reverse bridge being positioned at said back end;

said plurality of strings being wrapped from the said standard bridge, around said reverse bridge, through said body, and to said saddle by said plurality of looping assemblies;

said first leg being perpendicularly connected to said second leg;

said first leg being externally mounted onto said soundboard;

said second leg being externally mounted onto said back end;

said first string guide and said second string guide being connected onto said reverse bridge;

said first string guide and said second string guide being positioned opposite to each other along said second leg;

said first sleeve traversing through said back end adjacent to said reverse bridge;

said second sleeve traversing through said bridge plate, said soundboard, and said standard bridge;

said second sleeve being positioned in between said pinhole and said saddle; and said channel being traversing through said body from said first sleeve to said second sleeve.

13. The reverse bridge tension configuration for a stringed instrument as claimed in claim 12 comprises:

said standard bridge externally connected onto said body;

said bridge plate being internally connected onto said body adjacent to said standard bridge;

said soundboard being positioned perpendicular to both said front end and said back end; and said soundboard being positioned in between said standard bridge and said bridge plate.

14. The reverse bridge tension configuration for a stringed instrument as claimed in claim 12 comprises:

said pinhole and said saddle being positioned opposite to each other across said standard bridge; and said pinhole traversing through said standard bridge, said soundboard, and said bridge plate.

15. The reverse bridge tension configuration for a stringed instrument as claimed in claim 12 comprises:

a respective string from said plurality of strings;

a first end of said respective string being mounted within said pinhole by said bridge pin;

said respective string being directed towards said first string guide by said bridge pin;

said respective string being redirected towards said second string guide by said first string guide;

said respective string being redirected into said first sleeve by said second string guide;

said respective string traversing through said first sleeve, said channel, and said second sleeve;

said respective string being directed towards said saddle by said second sleeve; and said respective string being redirected towards said front end by said saddle.

* * * * *